United States Patent [19]

Golovanov et al.

[11] 4,090,473

[45] May 23, 1978

[54] STEAM GENERATOR FOR STEAM POWER PLANT

[76] Inventors: Nikolai Vasilievich Golovanov, prospekt Energetikov, 48, kv. 20; Vitaly Alexandrovich Ivanov, ulitsa Vavilovykh, 172, kv. 84; Vyacheslav Vladimirovich Mitor, ulitsa Parkhomenko, 2/13, kv. 95, all of Leningrad; Anatoly Alexeevich Parshin, ulitsa Lenina, 4, kv. 21, Taganrog Rostovskoi oblasti; Fedor Vasilievich Sapozhnikov, ulitsa Nikolaeva, 4, kv. 12, Moscow; Sergei Mikhailovich Ter-Minosian, Kotlostroitelnaya ulitsa, 21, kv. 10, Taganrog Rostovskoi oblasti; Evgeny Kirillovich Chavchanidze, prospekt Nauki, 24-1, kv. 107, Leningrad, all of U.S.S.R.

[21] Appl. No.: 690,776

[22] Filed: May 27, 1976

[51] Int. Cl.[2] ..... F22B 21/24

[52] U.S. Cl. ..... 122/6 A; 122/235 A; 122/276; 122/356

[58] Field of Search ..... 122/6 A, 235 R, 235 A, 122/275, 276, 279, 355, 356

[56] References Cited

U.S. PATENT DOCUMENTS

| | | | |
|---|---|---|---|
| 2,127,787 | 8/1938 | Schmidt | 122/275 |
| 2,170,343 | 8/1939 | Bailey | 122/235 |
| 2,170,345 | 8/1939 | Bailey et al. | 122/235 |
| 3,173,405 | 3/1965 | Evans | 122/6 A |

*Primary Examiner*—Kenneth W. Sprague
*Attorney, Agent, or Firm*—Haseltine, Lake & Waters

[57] ABSTRACT

A steam generator for a steam power plant, comprising a furnace for generating hot gases and a gas pass in communication therewith, the gas pass having a sectionalized chamber for hot gas cooling. The entire gas pass together with the chamber constitute a single construction unit built up of water walls arranged one above another in height and bent in a horizontal plane so that each element of each water wall has a different number of bends. The adjacent water walls are interconnected through the top points of the bends forming sections of the entire gas pass together with the sections of the cooling chamber. This results in the formation of a system of rigidly interconnected sections which constitutes the basis of the steam generator structure featuring high rigidity and a high bearing capacity. This allows obviating any additional appliances for fastening the generator and, hence, diminishing materially the metal requirements and simplifying both the erection and operation of the steam generator.

1 Claim, 14 Drawing Figures

STEAM GENERATOR FOR STEAM POWER PLANT

FIELD OF THE INVENTION

The present invention relates to heat-exchange devices and more particularly to steam generators for steam power plants.

The present invention may be most advantageous in case of steam generators with forced fluid (steam) circulation operating with steam or gas turbines rated at 300 MW and over.

PRIOR ART

Known in the art are steam generators, comprising a furnace device and a linked gas pass built up of water walls adapted for fluid circulation, said linked gas pass communicating with the furnace device, having a chamber for partial hot gas cooling and being subdivided by water walls into mutually parallel sections.

In said steam generators, the water walls are all-welded constructions made up of tubes adapted for the circulation of fluid, in this particular case, of steam. The furnace device is a high-turbulence combustion chamber featuring high heat liberation per unit furnace volume, said combustion chamber being made integrally with the chamber for partial hot gas cooling that is arranged thereabove constitutes a portion of the gas pass and whose walls are made up of the water walls of diversified configuration.

The front and rear water walls of the combustion chamber and of the chamber for partial hot gas cooling are built up of the water walls bent in a vertical plane and having an intricate configuration. The side water walls of the combustion chamber together with the chamber for partial hot gas cooling are formed by flat water walls similar in their outline to that of the front and rear water walls.

Moreover, mounted at the rear wall of the chamber for partial hot gas cooling parallel to its side walls are division walls; four said walls are mounted in each chamber section, each said wall having a width equal to ¼ of that of its side wall.

The remaining portion of the gas pass, which is a gas duct accommodating a vertical partition, is arranged close to the chamber for partial hot gas cooling, at its side. The duct is made up of the water walls of four types, each said type being bent in a different manner. The water walls of the first type make up the front duct wall facing the chamber for partial hot gas cooling. The water walls of the second type form the side walls, those of the third type — the rear wall and the flat water walls of the fourth type make up the partition. In this case the partition is mounted parallel to the front water wall and subdivides the duct interior into two vertical spaces in communication with one another through openings provided in the bottom portion of the partition. The space defined by the partition and the front duct wall communicates in its top portion with the chamber for partial hot gas cooling. The resulting zigzag conduit formed thereof is adapted for the passage of hot gases from the furnace device through the entire gas pass assuring repeated alteration in the direction of gas flow.

The chamber for partial hot gas cooling, referred to hereinafter as a partial gas pass cooling chamber, and its zigzag conduit are interconnected through a transverse passage made up of the two L-shaped water walls. Said walls are rigidly fixed with one their end to the top portion of the rear water walls of the partial gas pass cooling chamber and with their other end to the top portion of the front duct wall. At the points of attachment of said passage interconnecting the waterwall tubes the chamber and duct walls are provided with slots for the passage of hot gases from the partial gas pass cooling chamber through the transverse passage into its zigzag conduit.

Each of said spaces of the gas pass conduit accommodates convection heating surfaces.

Arranged above each of these spaces are two ducts in rolled plates, of which one is adapted for sealing the spaces of the zigzag gas pass conduit and the other one for discharging hot gases from the gas pass.

In the described steam generator all the water walls defining the generator are arranged so that the tubes of each water wall are essentially disposed concordantly to the direction of hot gas flow.

In this case all the water walls defining the furnace device, convection surfaces and the linked gas pass are suspended from a framework made in shape rolled stock, said framework being a rather complicated and cumbersome construction.

Moreover, to provide proper rigidity of the entire steam generator structure use is made of the so-called stiffening belts which are beams of shaped iron encompassing the furnace device and the linked gas pass at different levels in height.

However, owing to inevitable diversity of configurations of the water walls making up the steam generator, the use of the water walls of unified design presents a serious problem, complicating thereby the generator erection techniques. Moreover, said steam generator has difficult-of access zones, a feature which impedes its operation.

The construction of such a steam generator involves high metal consumption.

Among the other disadvantages of the prior-art steam generators of the type described is the water wall arrangement owing to which the tubes with the fluid circulating therein run concordantly to the direction of hot gas flow. Under these conditions the temperature of each water wall differs from that in the other waterwall tubes. Insofar as the spaces of the gas pass conduit are defined by various water walls, their junctions feature low strength which accounts for operational unreliability of said steam generator.

Moreover, the water walls of the diversified types require diverse hangers to attach them to the generator framework, a feature which complicates the sealing of the places through which the hangers extend into the ducts located above the spaces of said gas pass conduit.

Such a principle on which is based the attachment of the entire steam generator structure leads to a substantially higher metal requirements of the supporting structures, and creates serious difficulties in erection, operation and repairs of said steam generator.

SUMMARY OF THE INVENTION

The main object of the present invention is to provide a steam generator for a steam power plant, said steam generator having a gas pass whose design will enable an extensive application of water walls of unified design.

Another object of the invention is to provide an adequate rigidity and reliability of the entire steam generator structure.

Still another object is a considerable reduction in metal requirements of the steam generator.

The above and other objects are achieved in a steam generator for a steam power plant, said steam generator comprising a furnace device and a linked gas pass communicating therewith and made up of water walls adapted for fluid circulation, said gas pass having a chamber for partial hot gas cooling subdivided into mutually parallel sections.

According to the invention, the entire gas pass is built up of the water walls arranged one above another in height and bent in a horizontal plane, each element of each said water wall having a different number of bends and the adjacent water walls being interconnected through the top points of their bends, this resulting in the formation of gas pass sections together with said sections of the chamber for partial hot gas cooling.

Thus, the sectionalized gas pass has the serious advantage over that in the prior-art steam generators.

A system of such rigidly interconnected sections constitutes the basis of the steam generator structure featuring high rigidity and a high bearing capacity. Said structure does not require an awkward and metal-consuming framework, stiffening belts and hangers for fastening the water walls to the framework, a feature which facilitates substantially the erection, operation and repairs of the steam generator and diminishes its metal requirements.

Moreover, this embodiment makes it possible to assemble steam generators of various capacity of standard elements. Owing to the above-outlined principle the steam generator of the invention has a much larger heating surface per one meter of gas pass height as compared with the prior-art steam generator of the type described.

It is expedient that each element of each water wall be an all-welded construction of tubes arranged one above another and mutually parallel, said element being disposed so that its tubes be directed essentially at right angles to the direction of hot gas flow.

In this embodiment, the water-wall tubes are exposed to a transverse flow of hot gases, a feature contributing to an intense heat exchange between the hot gases and the fluid circulating in the tubes. This allows enhancing the efficiency per unit heat-exchange surface of the steam generator, which in turn makes it possible to decrease its overall dimensions in comparison with the prior-art steam generators of the same capacity and of the type described.

It is also sound practice that each element of each water wall have at least two inlet and two outlet headers, the tubes of said water wall element being connected to each header so that the fluid in the neighboring tubes are in counter flow.

Such an embodiment enables a uniform distribution of the fluid temperature within each water wall element. Moreover, this results in the neighboring elements of each water wall featuring a minimum temperature gradient which creates favorable conditions for their joints and, hence, ensures reliable operation of the steam generator.

Thus, as compared with the prior-art units, the herein-proposed steam generator is made up of water walls of unified design, is simple in erection and servicing, its structure featuring adequate rigidity and reliability in service.

BRIEF DESCRIPTION OF THE DRAWING

The nature of the invention will be clear from the following detailed description of one of its possible particular embodiments to be had in conjunction with the accompanying drawings in which.

DETAILED DESCRIPTION

Figure 1:
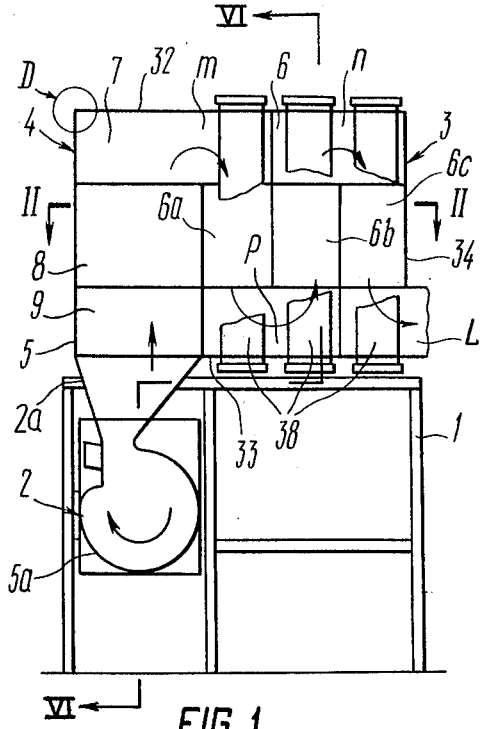
FIG. 1 shows diagrammatically a steam generator for a steam power plant (a longitudinal sectional view), according to the invention.

A steam generator for a steam power plant is mounted on a welded base 1 (FIG. 1) made from shape rolled stock.

The steam generator comprises a furnace device 2 and a linked gas pass 3 in communication therewith. In this case a part of the gas pass 3 adjoins the furnace device 2 and constitutes a partial hot gas cooling chamber 4, referred to hereinafter as a partial gas pass cooling chamber 4.

The furnace device 2 is arranged below the chamber 4 serving for partial cooling of the gas pass 3 and is a high-turbulence combustion chamber featuring high heat liberation per unit furnace volume; said combustion chamber may have any known configuration adaptable for this purpose.

The linked gas pass 3 is built up of water walls 5 arranged one above another in height and bent in a horizontal plane, said water walls 5 being bent so as to provide the formation of sections "A" (FIG. 2) in the chamber 4 for partial cooling of the gas pass 3 and sections "B" in the remaining portion of the linked gas pass 3. Each section "A" communicates with one of the sections "B", this resulting in the building up in the linked gas pass 3 of mutually zigzag conduits 6 with vertical spaces *6a*, *6b* and *6c* adapted for the passage of hot gases generated in the furnace device 2 (FIG. 1) (the direction of hot gas flow is indicated by arrows).

Each water wall 5 is built up in height of three elements: a top element 7, a central element 8 and a bottom element 9. Each water wall 5 may have several central elements 8 but their number in each of the water walls 5 must be one and the same.

Figure 3:
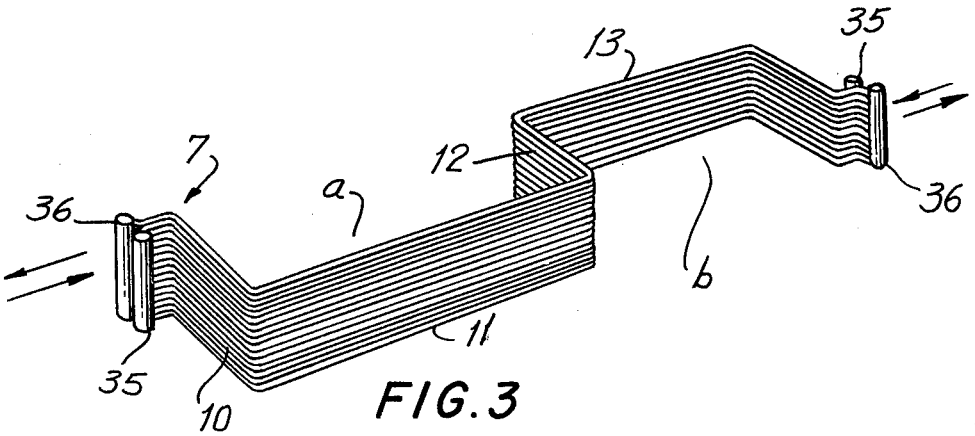
FIG. 3 diagrammatically shows a top element of one of the water walls, in enlarged perspective view.
Figure 4:
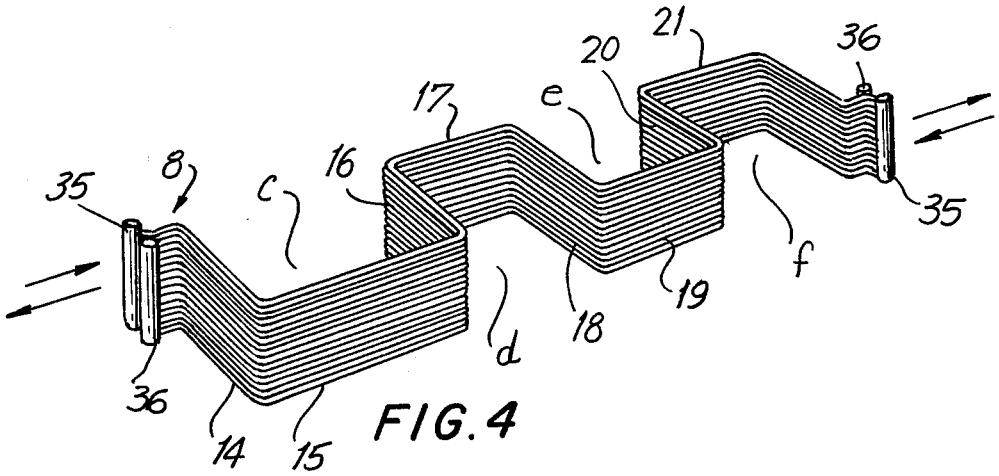
FIG. 4 shows diagrammatically a central element of one of the water walls on enlarged perspective view.

Each of the elements 7, 8 and 9 is an all-welded panel made up of tubes arranged parallel to one another in one row in the plane of the drawing (FIGS. 3 through 5), each panel 7, 8 and 9 having a different number of bends. Thus, the top panel 7 (FIG. 3) has three bends in the drawing plane. In this case its portions 10–12 form a concavity "*a*," its portions 12 and 13 forming an open convexity "*b*."

The central panel 8 (FIG. 4) has seven bends in the drawing plane, its portions 14–16 forming a concavity "*c*," portions 16–18 — a convexity "*d*," portions 18–20 — a concavity "*e*" and portions 20–21 — an open convexity "*f*."

The bottom panel 9 (FIG. 5) has five bends in the drawing plane, its portions 22–24 forming a concavity "*g*," portions 24–26 — a convexity "*h*" and portions 26–27 — an open concavity "*k*."

Figure 7:
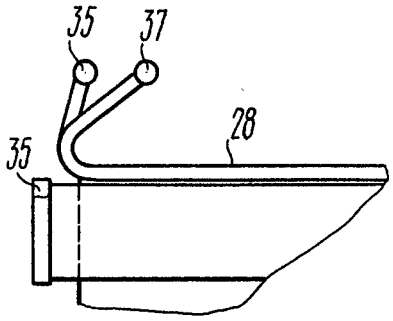
FIG. 7 shows unit D of FIG. 1 in enlarged view.

The width of the concavity "*a*" of the top panel 7 (FIG. 3) 7 (FIG. 7) is equal to the total width of the concavity "*e*" and the incomplete convexity "*f*" of the central panel 8 (FIG. 4) whereby the panels 7 and 8 on assembly form a passage "*n*" (FIG. 1) running between the spaces **6*b* and 6*c* of the zig-zag conduit 6**.

Figure 5:
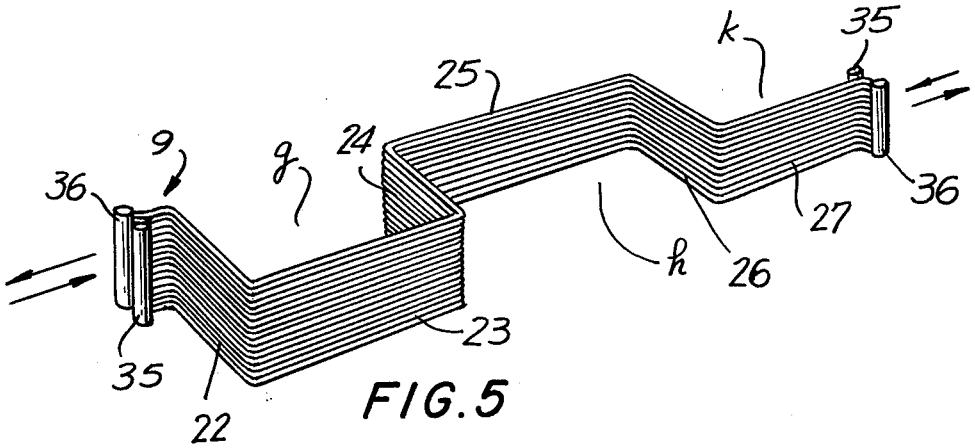
FIG. 5 shows diagrammatically a bottom element of one of the water walls, on enlarged perspective view.

The width of the concavity "D" of the central panel 8 (FIG. 4) amounts to that of the concavity "*g*" of the bottom panel 9 (FIG. 5).

The total width of the convexity "*d*" and concavity "*e*" of the central panel 8 (FIG. 4) is equal to the width of the convexity "*h*" of the bottom panel 9 (FIG. 5), whereby the panels 8 and 9 on assembly form a passage "*p*" (FIG. 1) interconnecting the spaces **6*a* and 6*b* of the zigzag conduit 6** in each section "B."

Said three panels 7–9 (FIGS. 3 through 5) on assembly form with their concavity "*a*" (partly) and concavities "*c*" and "*g*" three sides of the section "A" (FIG. 2) of the chamber 4 for partial gas pass cooling.

With a portion of the concavity "*a*" (FIGS. through 5), convexity "*d*" and a portion of the convexity "*h*" they form the space **6*a* (FIG. 1) of the zigzag conduit 6** of each section "*B*";

with a portion of the open convexity "*b*" (FIGS. 3 through 5), the concavity "*e*" and a portion of the convexity "*h*" the space **6*b* (FIG. 1) of the zigzag conduit 6** of each section "*B*";

with a portion of the open convexity "*b*" (FIGS. 3 through 5), incomplete convexity "*f*" and the open concavity "*k*" — the space **6*c* (FIG. 1) of the zigzag conduit 6** of each section "*B*".

In this case the spaces **6*a*, 6*b* and 6*c*** of each section "*B*" and section "A" in communication therewith are defined from three sides by one water wall 5. The fourth side of said sections is built-up of the adjacent water walls 5 upon connecting the top points of the bends of the corresponding panels 7, 8 and 9 of said water walls 5.

Figure 2:
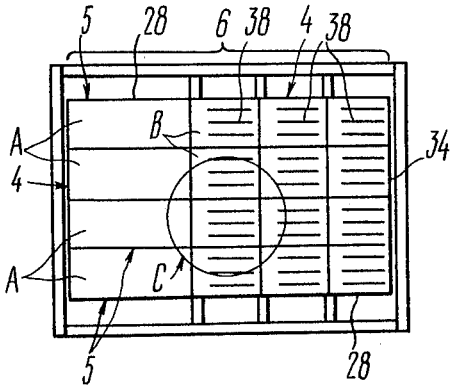
FIG. 2 is a section taken along line II—II in FIG. 1.

The fourth sides of the spaces of the extreme sections "A" and "B" form flat water walls 28 (FIG. 2).

Figure 8:
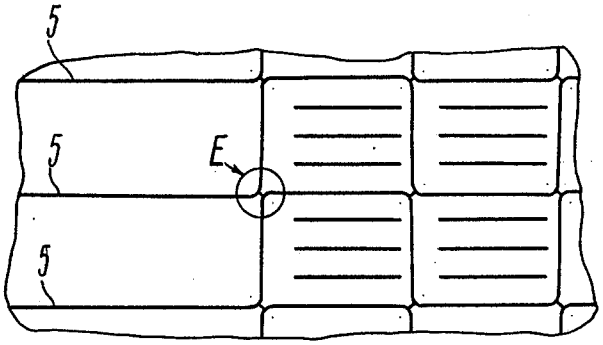
FIG. 8 shows unit C of FIG. 2 in enlarged view.
Figure 9:
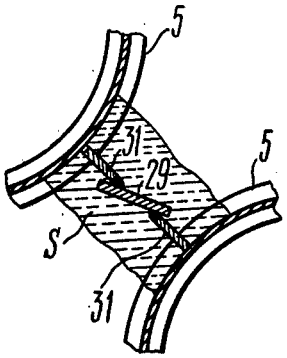
FIG. 9 shows unit E of FIG. 8 in enlarged view.

The panels 7–9 (FIG. 8) of the water walls 5 can be interconnected through their top points by using one of the two possible embodiments: the first one (FIG. 9) envisages the use of a coupling plate 29 to which a heat-insulating compound "S" is applied, the second one (FIG. 10) comprises a tube 30 in which working fluid is circulating to equalize the temperature of the elements.

According to both these embodiments, welded with one of its edges to each panel along the generatrix of each bend top point is a rib 31 in the form of a plate located in a plane essentially normal to the tangent to the bend top (in the drawing plane).

According to the first embodiment (FIG. 9) the ribs 31 of the adjacent bend top points are interconnected by means of the coupling plate 29 welded therebetween. The junction of the bend tops is coated with the insulating compound "S."

Figure 10:
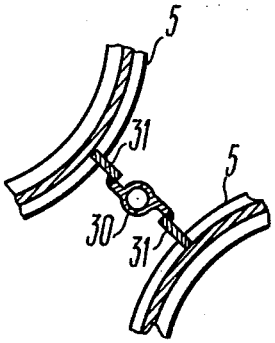
FIG. 10 shows another possible embodiment of unit E of FIG. 9 in enlarged view.

According to the second embodiment (FIG. 10), the ribs 31 of the adjacent bend tops are interconnected with the aid of the tube 30 having two diametrically opposite ribs disposed along its generatrix. Each of said ribs is welded along its length to a corresponding rib 31, as is shown in FIG. 10.

The sections "A" and "B" are protected from above and from below by flat water walls, 32 and 33 respectively (FIG. 1). The rear wall of the linked gas pass 3 made up of the flat water wall 34 is provided with an outlet "L" for hot gases.

Figure 6:
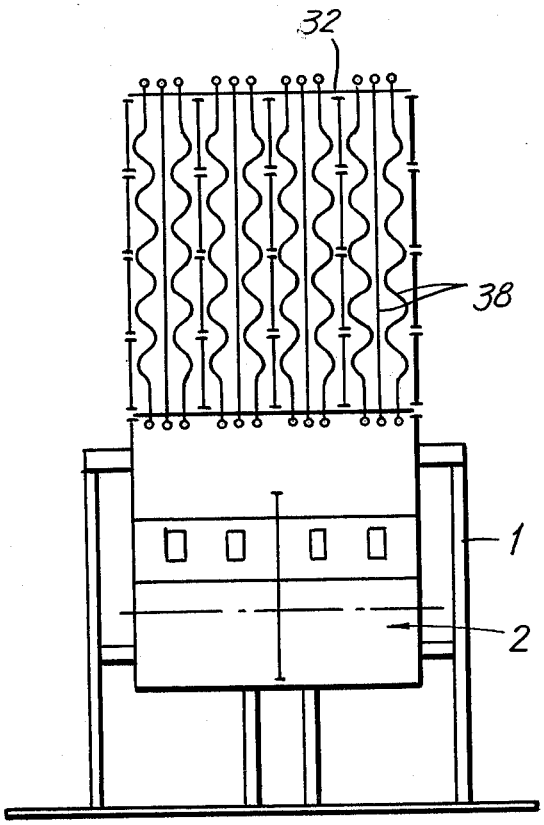
FIG. 6 is a sectional view taken on line VI—VI in FIG. 1.

The water walls 5 are arranged so that the tubes in each of their panels 7, 8 and 9 are directed essentially at right angles to the direction of hot gas flow. In this case each of the panels 7, 8 and 9 (FIG. 6) of the water wall 5 has two inlet and two outlet headers 35. Each of the tubes of the water-wall panels 7, 8 and 9 is connected with one its end to the inlet header 35, its other end being coupled to the outlet header 36. But the tubes are connected so that similar ends of the two adjacent tubes are coupled to unlike headers. As a result, the fluid in the adjacent tubes is in a counterflow.

The outlet headers (not shown in the drawing) of the water walls **5*a* forming the furnace device 2 (FIG. 1) are coupled in a known manner through a mixer (not shown in the drawing) with the inlet headers 35 of the panels 9 and water wall 38**.

The outlet headers 36 of the panels 9 and water wall 33 are coupled with the inlet headers 35 of the panels 8. The outlet headers 36 of the panels 8 are coupled with the inlet headers 35 of the panels 7. The outlet headers 36 of the panels 7 are coupled with the inlet headers (FIG. 7) of the water wall 32.

The outlet headers 37 of the water wall 32 are connected in a known manner to the inlet headers (not shown in the drawing) of convection surfaces 38 (FIGS. 1 and 6) which are accommodated in the spaces **6*a*, 6*b* and 6*c*** and coupled with various turbine stages (not shown in the drawings).

To increase the output of the steam power plant and to provide an optimum layout of the steam generator and of the other plant equipment, the layout with doubled steam generators can be employed.

Figure 11:
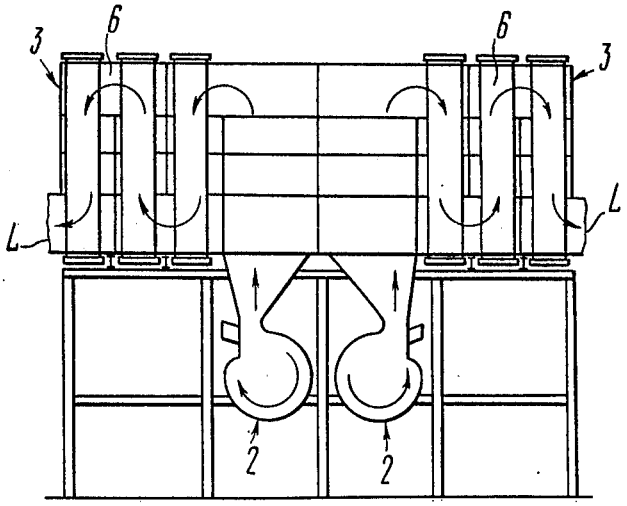
FIG. 11 shows diagrammatically a first embodiment of a doubled steam generator.

Said layout with the doubled steam generators can have two embodiments;

The first embodiment (FIG. 11) envisages an adjacent arrangement of the furnace devices 2. The outlets "L" for hot gases are directed into opposite sides, the direction of hot gas flow in the zigzag conduit 6 being indicated by arrows.

Figure 12:
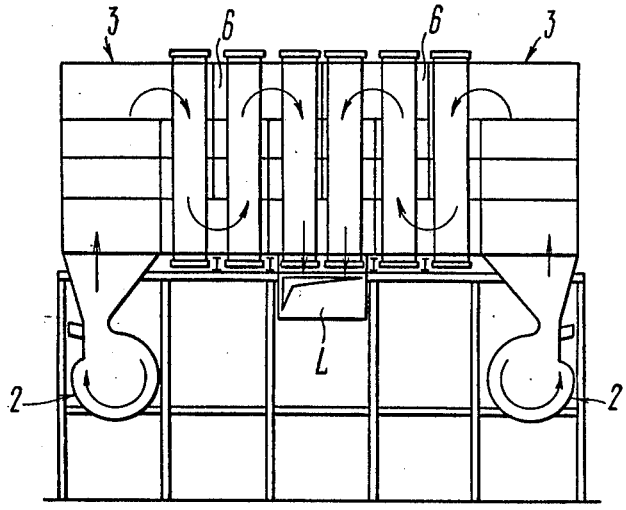
FIG. 12 shows a second embodiment of the doubled steam generator.
Figure 13:
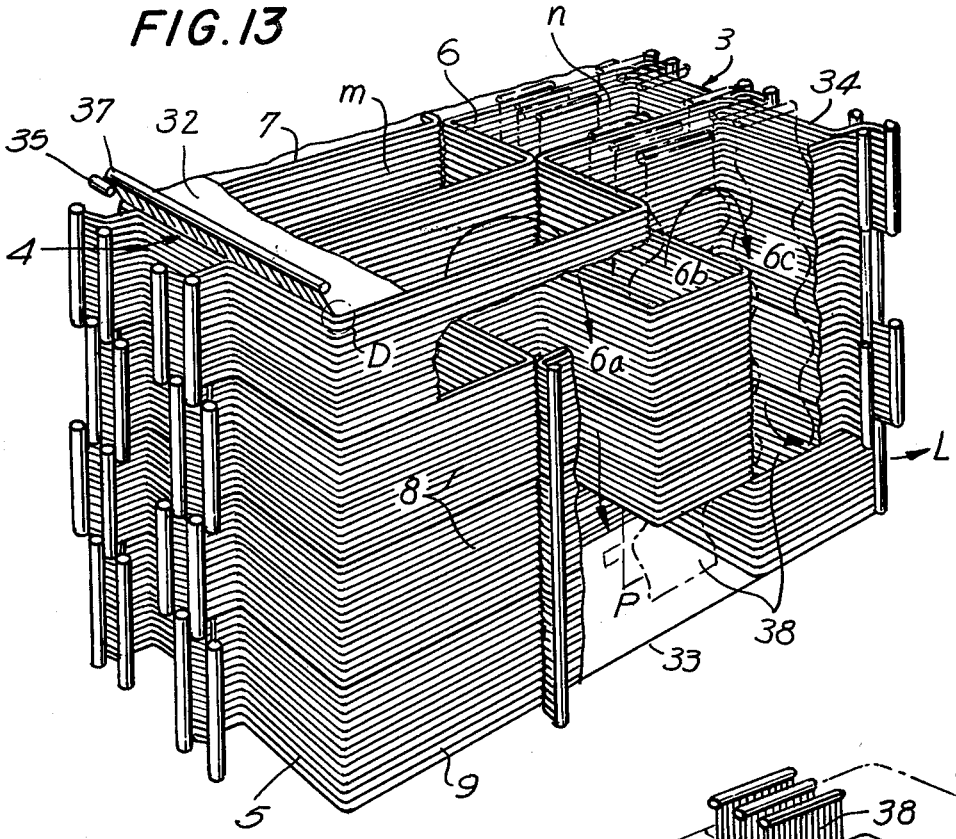
FIG. 13 is a perspective view showing the assembly of the top, central and bottom water walls.
Figure 14:
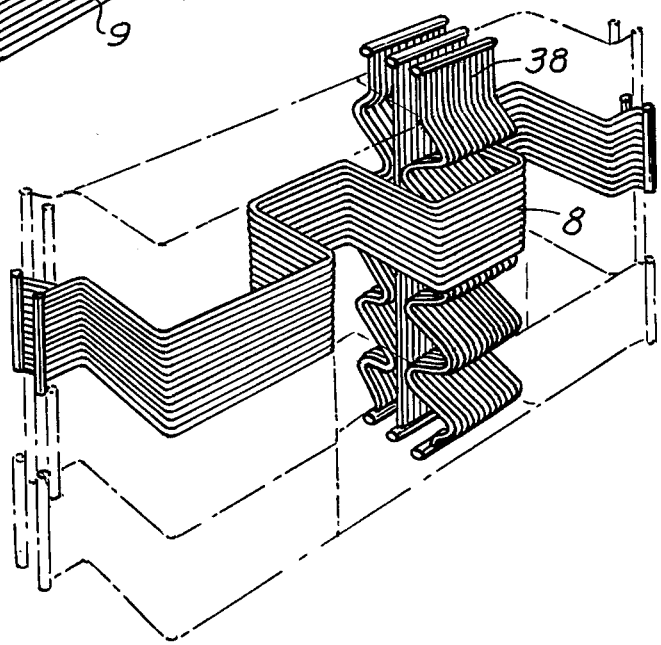
FIG. 14 is a perspective view showing the relative arrangement of the structural elements forming the gas pass and the connection surface in each of the cells of the gas conduits.

The second embodiment (FIG. 12) envisages a spaced arrangement of the furnace devices 2. In this case the length of the water walls 5 is equal to a double length of the walls 5 in the above-outlined steam generator, according to the invention, the water walls 5 forming concurrently, according to the second possible embodiment, both gas passes 3 with a common hot gas outlet "L."

The steam generator for a steam power plant operates in the following manner.

The tubes of all the water walls 5 and 5*a* are filled in a known manner with fluid, in this particular case with water, fed through the inlet headers 35. An air-fuel mixture is supplied into the furnace device 2 (FIG. 1), and flame ignition is effected.

The fuel burns up with the ensuing generation of hot gases in the furnace device 2.

The hot gases at a temperature of 1400°–1600° C enter the sections "A" of the chamber 4 for partial gas pass cooling where in a heat exchange between the hot gases and the fluid circulating in the tubes of the water walls 5 takes place. As the temperature of the fluid rises, the pressure in the tubes of the water walls 5 and 5*a* will grow and the fluid commences to circulate.

From the tubes of the water walls 5*a* making up the furnace device 2 water flows into the tubes of the water walls 5, making up the gas pass 3.

In the tubes of the bottom panel 9 some steam is generated and in the tubes of the water-wall panels 8 and 7 water is completely converted to steam. Next the working fluid (steam) enters the tubes of the panel 32.

In the sections "A" of the chamber 4 for partial gas pass cooling hot gases are simultaneously cooled to a temperature of 1000–1100° C. This is necessary to create optimum operating conditions for the convection surfaces 38 accommodated in the spaces 6*a* of the zigzag conduit 6 of each section "B." Hot gases enter said spaces 6*a* through the passages "*m*" from the sections "A" of the chamber 4 for partial gas pass cooling. Here the steam admitted from the tubes of the panel 32 is superheated to a temperature at which it is then delivered to the turbine. Reheat steam passes in succession to the convection surfaces 38 accommodated in the spaces 6*c* and 6*b* of each zigzag conduit 6. Here the steam is superheated to a preset temperature to be returned to the turbine. The gases flow from the space 6*a* through the passage "*p*" into the space 6*b* from which they proceed through the passage "*n*" into the space 6*c* and then through the outlet "L" to the heating surfaces not associated with the proposed steam generator.

It should be noted that heat exchange between the hot gases and the fluid circulating in the water walls 5 takes place with the water-wall tubes being exposed to a transverse flow of the hot gases travelling with a high speed, especially in the spaces 6*a*, 6*b* and 6*c*.

The steam generator operates on a continuous steam generation cycle.

What we claim is:

1. A steam generator for a steam power plant, comprising a furnace for generating hot gases; a gas pass with means providing communication with said furnace to provide a passage for said hot gases; said gas pass having a chamber for partial hot gas cooling arranged above said furnace and including means dividing the chamber into mutually parallel sections; water walls adapted for fluid circulation and constituting said gas pass; said water walls being disposed one above another in height and bent in a horizontal plane so that each element of each water wall has a different number of bends, the adjacent water walls being interconnected through the top points of said bends resulting in the formation of gas pass sections together with said sections of the chamber for partial hot gas cooling, each water wall element comprising an all-welded construction including tubes arranged one above another and mutually parallel so that the tubes of each element are directed essentially at right angles to the direction of hot gas flow, each water wall element including at least two inlet and two outlet headers, the tubes of said water wall element being connected to each of said headers so that the fluid in the adjacent tubes flow in counterflow.

* * * * *